US011221013B2

(12) United States Patent
Nakane et al.

(10) Patent No.: US 11,221,013 B2
(45) Date of Patent: Jan. 11, 2022

(54) CENTRIFUGAL COMPRESSOR

(71) Applicant: KABUSHIKI KAISHA TOYOTA JIDOSHOKKI, Aichi (JP)

(72) Inventors: Yoshiyuki Nakane, Aichi-ken (JP); Takahito Kunieda, Aichi-ken (JP); Kaho Takeuchi, Aichi-ken (JP); Ryo Umeyama, Aichi-ken (JP); Satoru Mitsuda, Aichi-ken (JP); Ryosuke Fukuyama, Aichi-ken (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 118 days.

(21) Appl. No.: 16/580,338

(22) Filed: Sep. 24, 2019

(65) Prior Publication Data

US 2020/0102964 A1 Apr. 2, 2020

(30) Foreign Application Priority Data

Sep. 28, 2018 (JP) ..... JP2018-185311

(51) Int. Cl.
*F04D 29/06* (2006.01)
*F04D 27/00* (2006.01)
(Continued)

(52) U.S. Cl.
CPC ..... *F04D 29/06* (2013.01); *F01D 25/18* (2013.01); *F01D 25/186* (2013.01); *F04D 17/12* (2013.01); *F04D 27/009* (2013.01); *F04D 29/061* (2013.01); *F04D 29/102* (2013.01); *F05D 2260/98* (2013.01)

(58) Field of Classification Search
CPC ..... F04D 29/061; F04D 29/102; F01D 25/18; F01D 25/186; F05D 2260/98; F05D 2260/4331
See application file for complete search history.

(56) References Cited

U.S. PATENT DOCUMENTS 3,976,165 A * 8/1976 Pilarczyk ..... F04D 25/04 184/6.16
4,170,873 A * 10/1979 Milo ..... F01D 25/20 184/6.11
(Continued)

FOREIGN PATENT DOCUMENTS

CN 204646668 U 9/2015
JP H11-107986 4/1999
(Continued)

*Primary Examiner* — Courtney D Heinle
*Assistant Examiner* — Andrew J Marien
(74) *Attorney, Agent, or Firm* — Greenblum & Bernstein, P.L.C.

(57) ABSTRACT

A centrifugal compressor includes a low-speed shaft, an impeller, a speed increaser, a housing, a separation wall, a shaft insertion hole, a seal member, an oil pan, an oil supply passage, an oil return passage, and a pressure reduction passage. The impeller is integrally rotated with a high-speed shaft. The housing has therein an impeller chamber accommodating the impeller and a speed increaser chamber accommodating the speed increaser. The centrifugal compressor includes a bypass passage having a first end communicating with the speed increaser chamber and a second end communicating with the oil pan.

1 Claim, 2 Drawing Sheets

(51) Int. Cl.

| | |
|---|---|
| ***F04D 17/12*** | (2006.01) |
| ***F01D 25/18*** | (2006.01) |
| ***F04D 29/10*** | (2006.01) |

(56) References Cited

U.S. PATENT DOCUMENTS

| | | | | |
|---|---|---|---|---|
| 4,211,070 | A * | 7/1980 | Portmann | F01D 25/34 415/175 |
| 9,982,687 | B2 | 5/2018 | Mitsuda et al. | |
| 2006/0207254 | A1* | 9/2006 | Labala | F01D 25/18 60/605.3 |
| 2009/0078506 | A1* | 3/2009 | Franconi | B64D 13/02 184/5.1 |
| 2015/0167689 | A1* | 6/2015 | Oda | F25B 1/10 415/110 |
| 2016/0281740 | A1* | 9/2016 | Mitsuda | F04D 17/10 |
| 2017/0002738 | A1* | 1/2017 | Sheridan | F02C 7/06 |
| 2017/0002824 | A1* | 1/2017 | Hiwata | F04D 29/0513 |
| 2019/0218936 | A1* | 7/2019 | Fomison | F16C 37/007 |

FOREIGN PATENT DOCUMENTS

| | | |
|---|---|---|
| JP | 2016-186238 | 10/2016 |
| JP | 2017-015017 | 1/2017 |

* cited by examiner

CENTRIFUGAL COMPRESSOR

CROSS-REFERENCE TO RELATED APPLICATION

This application claims priority to Japanese Patent Application No. 2018-185311 filed on Sep. 28, 2018, the entire disclosure of which is incorporated herein by reference.

BACKGROUND ART

The present disclosure relates to a centrifugal compressor.

A centrifugal compressor includes a low-speed shaft, an impeller integrally rotating with a high-speed shaft to compress gas, and a speed increaser transmitting power of the low-speed shaft to the high-speed shaft. A housing of the centrifugal compressor has therein an impeller chamber accommodating the impeller and a speed increaser chamber accommodating the speed increaser. The impeller chamber is separated from the speed increaser chamber by a separation wall. The separation wall has a shaft insertion hole extending therethrough. The high-speed shaft extends from the speed increaser chamber into the impeller chamber through the shaft insertion hole.

Japanese Patent Application Publication No. 2016-186238 discloses the above-described centrifugal compressor, in which oil is supplied to the speed increaser to prevent friction and seizure of a sliding area between the high-speed shaft and the speed increaser. The centrifugal compressor includes an oil pan for storing therein oil to be supplied to the speed increaser chamber, an oil supply passage through which the oil stored in the oil pan is supplied to the speed increaser chamber, and an oil return passage through which the oil in the speed increaser chamber is returned to the oil pan. The oil is supplied to the speed increaser in the speed increaser chamber from the oil pan through the oil supply passage, stored in the speed increaser chamber, and returned to the oil pan through the oil return passage. A seal member is disposed between the outer circumferential surface of the high-speed shaft and the inner circumferential surface of the shaft insertion hole. The seal member prevents leakage of the oil stored in the speed increaser chamber into the impeller chamber through the shaft insertion hole.

However, pressure in the impeller chamber is increased as gas is compressed with rotation of the impeller, so that gas may leak from the impeller chamber into the speed increaser chamber through a gap between the outer circumferential surface of the high-speed shaft and the inner circumferential surface of the shaft insertion hole. This leakage increases the pressure in the speed increaser chamber. Then, under the circumstances where pressure of the impeller chamber is lower than that of the speed increaser chamber, for example, the impeller rotates at a low speed or the operation of the centrifugal compressor stops, oil in the speed increaser chamber may leak into the impeller chamber through the gap between the outer circumferential surface of the high-speed shaft and the inner circumferential surface of the shaft insertion hole.

One idea to restrict an increase of the pressure in the speed increaser chamber is to form a pressure reduction passage communicating with the oil pan and the outside in the centrifugal compressor. For example, in the case where the oil supply passage and the oil return passage are filled with oil during stoppage of operation of the centrifugal compressor, the speed increaser chamber becomes a closed space. Then, when the temperature in the speed increaser chamber increases, the oil in the speed increaser chamber is pushed out by gas expanded in the speed increaser chamber and flows out to the oil return passage. The oil flows into the oil pan through the oil return passage, increasing the level of the oil in the oil pan. As the oil level in the oil pan increases, the oil may leak into the outside through the pressure reduction passage, thereby reducing an amount of oil supplied to the speed increaser.

The present disclosure has been made in view of the above circumstances and is directed to providing a centrifugal compressor that restricts the reduction of an amount of oil supplied to a speed increaser in addition to restricting an increase of the pressure in the speed increaser chamber.

SUMMARY

In accordance with an aspect of the present disclosure, there is provided a centrifugal compressor that includes a low-speed shaft, an impeller, a speed increaser, a housing, a separation wall, a shaft insertion hole, a seal member, an oil pan, an oil supply passage, an oil return passage, and a pressure reduction passage. The impeller is integrally rotated with a high-speed shaft to compress gas. The speed increaser transmits power of the low-speed shaft to the high-speed shaft. The housing has therein an impeller chamber accommodating the impeller and a speed increaser chamber accommodating the speed increaser. The separation wall separates the impeller chamber from the speed increaser chamber. The shaft insertion hole through which the high-speed shaft is inserted is formed in the separation wall. The seal member is disposed between an outer circumferential surface of the high-speed shaft and an inner circumferential surface of the shaft insertion hole. The oil pan stores therein oil supplied to the speed increaser. Oil stored in the oil pan is supplied to the speed increaser chamber through the oil supply passage. Oil in the speed increaser chamber is returned to the oil pan through the oil return passage. The pressure reduction passage communicates with the oil pan and the outside. The centrifugal compressor includes a bypass passage having a first end communicating with the speed increaser chamber and a second end communicating with the oil pan.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

Figure 1:
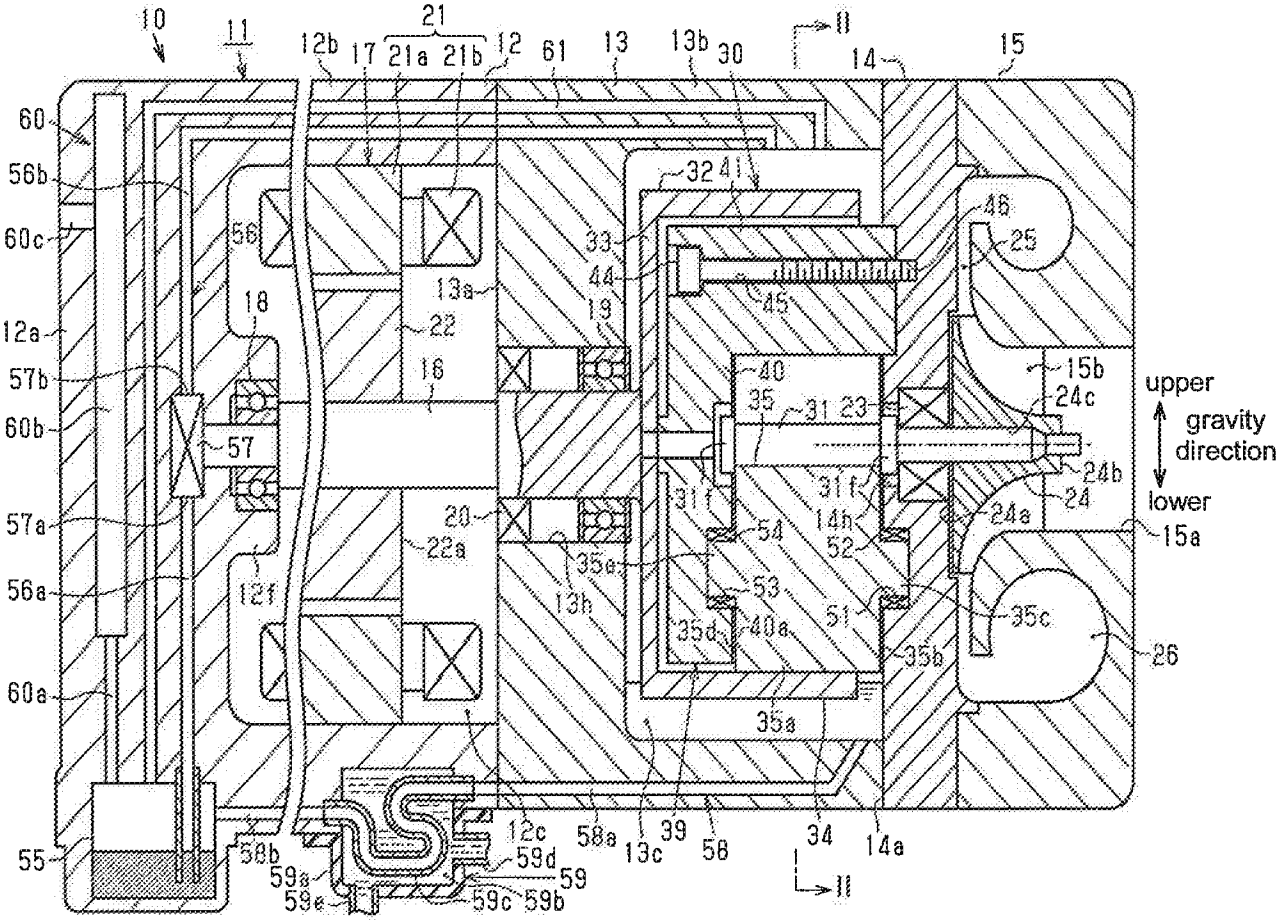
FIG. 1 is a longitudinal cross-sectional view showing a centrifugal compressor according to an embodiment of the present disclosure.
Figure 2:
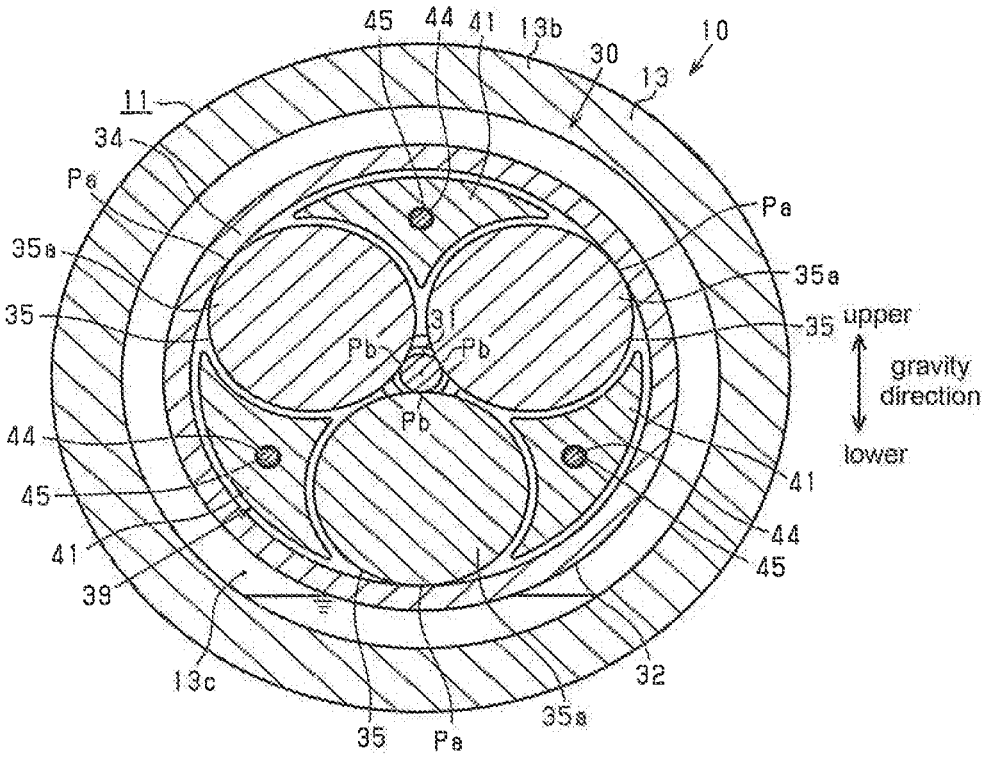
FIG. 2 is a cross-sectional view along line II-II of FIG. 1.

The following will describe an embodiment of a centrifugal compressor with reference to FIGS. 1 and 2. The centrifugal compressor according to the present embodiment is mounted on a fuel cell vehicle (FCV), which travels by using a fuel cell as a power source, and supplies air to a fuel cell.

Referring to FIG. 1, a housing 11 of a centrifugal compressor 10 includes a motor housing 12, a speed increaser housing 13 connected to the motor housing 12, a plate 14 connected to the speed increaser housing 13, and a compressor housing 15 connected to the plate 14. The motor housing 12, the speed increaser housing 13, the plate 14, and the compressor housing 15 are made of metallic materials, such as aluminum. The housing 11 has a substantially cylindrical shape. The motor housing 12, the speed increaser housing 13, the plate 14, and the compressor housing 15 are arranged in this order in an axial direction of the housing 11.

The motor housing 12 is formed in a bottomed cylindrical shape, and has a disk-like bottom wall 12*a* and a circumferential wall 12*b* cylindrically extending from the outer circumferential edge of the bottom wall 12*a*. The speed increaser housing 13 is formed in a bottomed cylindrical shape, and has a disk-like bottom wall 13*a* and a circumferential wall 13*b* cylindrically extending from the outer circumferential edge of the bottom wall 13*a*.

An end portion of the circumferential wall 12*b* located on the opposite side to the bottom wall 12*a* in the motor housing 12 is connected to the bottom wall 13*a* of the speed increaser housing 13. In addition, an opening formed by the circumferential wall 12*b* and located on the opposite side to the bottom wall 12*a* in the motor housing 12 is closed by the bottom wall 13*a* of the speed increaser housing 13. The bottom wall 13*a* has at the central part thereof a hole 13*h*.

An end portion of the circumferential wall 13*b* located on the opposite side to the bottom wall 13*a* in the speed increaser housing 13 is connected to the plate 14. In addition, an opening formed by the circumferential wall 13*b* and located on the opposite side to the bottom wall 13*a* in the speed increaser housing 13 is closed by the plate 14. The plate 14 has at the central part thereof a shaft insertion hole 14*h*.

The compressor housing 15 is connected to the opposite surface of the plate 14 to the speed increaser housing 13. The compressor housing 15 has an intake port 15*a* through which air corresponding to gas is sucked in. The intake port 15*a* is an opening located at a central part of an end surface of the compressor housing 15 on the opposite side to the plate 14, and extends from such central part in the axial direction of the housing 11.

The centrifugal compressor 10 includes a low-speed shaft 16 and an electric motor 17 rotating the low-speed shaft 16. The housing 11 has therein a motor chamber 12*c* accommodating the electric motor 17. The motor chamber 12*c* is defined by the inner surface of the bottom wall 12*a*, the inner circumferential surface of the circumferential wall 12*b* of the motor housing 12, and the outer surface of the bottom wall 13*a* of the speed increaser housing 13. The motor housing 12 accommodates the low-speed shaft 16, which is coaxial with the motor housing 12. The low-speed shaft 16 is made of metallic materials, such as iron and alloy.

A cylindrical boss portion 12*f* protrudes from the inner surface of the bottom wall 12*a* of the motor housing 12. A first end portion of the low-speed shaft 16 near the boss portion 12*f* is inserted in the boss portion 12*f*. A first bearing 18 is disposed between the first end portion of the low-speed shaft 16 and the boss portion 12*f*. Thus, the first end portion of the low-speed shaft 16 is rotatably supported by the bottom wall 12*a* of the motor housing 12 via the first bearing 18.

A second end portion of the low-speed shaft 16 near the speed increaser housing 13 is inserted in the hole 13*h*. A second bearing 19 is disposed between the second end portion of the low-speed shaft 16 and the hole 13*h*. Thus, the second end portion of the low-speed shaft 16 is rotatably supported by the bottom wall 13*a* of the speed increaser housing 13 via the second bearing 19. Accordingly, the low-speed shaft 16 is rotatably supported in the housing 11. The second end portion of the low-speed shaft 16 extends from the motor chamber 12*c* into the speed increaser housing 13 through the hole 13*h*.

A seal member 20 is disposed between the second end portion of the low-speed shaft 16 and the hole 13*h*. The seal member 20 is located closer to the motor chamber 12*c* than the second bearing 19 is located, interposed between the second end portion of the low-speed shaft 16 and the hole 13*h*. The seal member 20 seals a gap between the outer circumferential surface of the low-speed shaft 16 and the inner circumferential surface of the hole 13*h*.

The electric motor 17 is configured of a cylindrical stator 21 and a rotor 22 disposed inside the stator 21. The rotor 22 is fixed to the low-speed shaft 16 and integrally rotates with the low-speed shaft 16. The stator 21 is disposed to surround the rotor 22. The rotor 22 has a cylindrical rotor core 22*a* attached fixedly to the low-speed shaft 16 and a plurality of permanent magnets (not shown) disposed in the rotor core 22*a*. The stator 21 has a cylindrical stator core 21*a* fixed to the inner circumferential surface of the circumferential wall 12*b* of the motor housing 12 and a coil 21*b* wound around the stator core 21*a*. When electric current flows through the coil 21*b*, the rotor 22 rotates integrally with the low-speed shaft 16.

The centrifugal compressor 10 includes a high-speed shaft 31 and a speed increaser 30 transmitting power of the low-speed shaft 16 to the high-speed shaft 31. The housing 11 has therein a speed increaser chamber 13*c* accommodating the speed increaser 30. The speed increaser chamber 13*c* is defined by the inner surface of the bottom wall 13*a*, the inner circumferential surface of the circumferential wall 13*b* of the speed increaser housing 13, and the plate 14. Oil is stored in the speed increaser chamber 13*c*. The seal member 20 prevents leakage of the oil stored in the speed increaser chamber 13*c* into the motor chamber 12*c* through the gap between the outer circumferential surface of the low-speed shaft 16 and the inner circumferential surface of the hole 13*h*.

The high-speed shaft 31 is made of metallic materials, such as iron or alloy. The speed increaser chamber 13*c* accommodates the high-speed shaft 31, which is coaxial with the speed increaser housing 13. An end portion of the high-speed shaft 31 on the opposite side to the motor housing 12 extends into the compressor housing 15 through the shaft insertion hole 14*h* of the plate 14. The high-speed shaft 31 is coaxial with the low-speed shaft 16.

The centrifugal compressor 10 includes an impeller 24 attached to the high-speed shaft 31. The housing 11 has therein an impeller chamber 15*b* accommodating the impeller 24. The impeller chamber 15*b* is defined by the compressor housing 15 and the plate 14. The plate 14 corresponding to the separation wall of the present disclosure separates the impeller chamber 15*b* from the speed increaser chamber 13*c*. The shaft insertion hole 14*h* through which the high-speed shaft 31 is inserted is formed in the plate 14 corresponding to the separation wall.

A seal member 23 is disposed between the outer circumferential surface of the high-speed shaft 31 and the inner circumferential surface of the shaft insertion hole 14*h*. The seal member 23 is, for example, a mechanical seal. The seal member 23 seals the gap between the outer circumferential surface of the high-speed shaft 31 and the inner circumferential surface of the shaft insertion hole 14*h*. The seal member 23 prevents leakage of the oil stored in the speed increaser chamber 13*c* into the impeller chamber 15*b* through the gap between the outer circumferential surface of the high-speed shaft 31 and the inner circumferential surface of the shaft insertion hole 14*h*.

The impeller chamber 15*b* is in communication with the intake port 15*a*. The impeller chamber 15*b* is a substantially truncated conical hollow the diameter of which expands gradually as distanced away from the intake port 15*a* in the axial direction of the housing 11. A projecting end portion of the high-speed shaft 31 projects into the compressor housing 15, specifically into the impeller chamber 15*b*.

The impeller 24 has a substantially truncated conical shape the diameter of which decreases gradually as extending from a rear surface 24*a* of the impeller 24 toward a distal end surface 24*b* of the impeller 24. The impeller 24 has a hole 24*c* through which the high-speed shaft 31 is inserted. The hole 24*c* extends in a direction of the rotational axis of the impeller 24. In the impeller 24, the projecting end portion of the high-speed shaft 31 projects into the compressor housing 15 through the hole 24*c*. The impeller 24 is attached to the high-speed shaft 31 so as to be rotatable integrally with the high-speed shaft 31. With this configuration, the impeller 24 is rotated with the rotation of the high-speed shaft 31, so that air sucked from the intake port 15*a* is compressed. Therefore, the impeller 24 is integrally rotated with the high-speed shaft 31 to compress air.

The centrifugal compressor 10 includes a diffuser passage 25 into which the air compressed by the impeller 24 flows and a discharge chamber 26 into which the air passing through the diffuser passage 25 flows.

The diffuser passage 25 is defined by the plate 14 and the surface of the compressor housing 15 facing the plate 14. The diffuser passage 25 is located radially outward of the impeller chamber 15*b* relative to the high-speed shaft 31, and in communication with the impeller chamber 15*b*. The diffuser passage 25 is annularly formed to surround the impeller 24 and the impeller chamber 15*b*.

The discharge chamber 26 is located radially outward of the diffuser passage 25 relative to of the high-speed shaft 31, and in communication with the diffuser passage 25. The discharge chamber 26 has an annular shape. The impeller chamber 15*b* is in communication with the discharge chamber 26 via the diffuser passage 25. The air compressed by the impeller 24 is further compressed by passing through the diffuser passage 25. Then, the air flows into the discharge chamber 26 and is subsequently discharged from the discharge chamber 26.

The speed increaser 30 transmits rotation of the low-speed shaft 16 to the high-speed shaft 31, so that the high-speed shaft 31 rotates at a higher speed than the low-speed shaft 16 rotates. The speed increaser 30 is of a so-called traction drive type (friction roller type). The speed increaser 30 includes a ring member 32 connected to the second end portion of the low-speed shaft 16. The ring member 32 is made of metal. The ring member 32 rotates with rotation of the low-speed shaft 16. The ring member 32 is formed in a bottomed cylindrical shape, and has a disk-like base 33 connected to the second end portion of the low-speed shaft 16 and a cylindrical portion 34 cylindrically extending from the outer edge portion of the base 33. The base 33 extends in the radial direction of the low-speed shaft 16 relative to the low-speed shaft 16. The cylindrical portion 34 is coaxial with the low-speed shaft 16.

Referring to FIG. 2, a part of the high-speed shaft 31 is disposed in the cylindrical portion 34. The speed increaser 30 includes three rollers 35 disposed between the cylindrical portion 34 and the high-speed shaft 31. The three rollers 35 are made of metallic materials, which are the same metallic materials as those of the high-speed shaft 31, such as iron and alloy. The three rollers 35 are arranged in the circumferential direction of the high-speed shaft 31 at specified intervals (e.g., at 120-degree intervals). All the three rollers 35 have the same shape. The three rollers 35 are in contact with both the inner circumferential surface of the cylindrical portion 34 and the outer circumferential surface of the high-speed shaft 31.

Referring to FIG. 1, each roller 35 has a cylindrical roller portion 35*a*, a first protrusion 35*c* protruding from a first end surface 35*b* in an axial direction of the roller portion 35*a*, and a second protrusion 35*e* protruding from a second end surface 35*d* in the axial direction of the roller portion 35*a*. The roller portion 35*a*, the first protrusion 35*c* and the second protrusion 35*e* are coaxial with each other. The direction in which the central axis of the roller portion 35*a* of the each roller 35 extends coincides with the direction of the central axis of the high-speed shaft 31. The outer diameter of the roller portions 35*a* is larger than that of the high-speed shaft 31.

Referring to FIGS. 1 and 2, the speed increaser 30 includes a supporting member 39 that cooperates with the plate 14 to rotatably support the rollers 35. The supporting member 39 is disposed inside the cylindrical portion 34. The supporting member 39 has a disk-like supporting base 40 and three cylindrical stand walls 41 straightly extending from the supporting base 40. The supporting base 40 is disposed so as to face the plate 14 in the direction of the rotational axis of the rollers 35. The three stand walls 41 extend from a surface 40*a* of the supporting base 40 facing the plate 14. The three stand walls 41 are disposed in the corresponding three spaces that are each defined by the inner circumferential surface of the cylindrical portion 34 and the outer circumferential surfaces of two adjacent roller portions 35*a* so as to fill the spaces.

The supporting member 39 has three bolt insertion holes 45 through which bolts 44 are inserted. The bolt insertion holes 45 are formed to pass through the corresponding three stand walls 41 in a direction of the rotational axis of the rollers 35. Referring to FIG. 1, the plate 14 has internal thread holes 46 which communicate with the bolt insertion holes 45 in a surface 14*a* of the plate 14 facing the supporting member 39. The supporting member 39 is attached to the plate 14 by screwing the bolts 44 inserted into the internal thread holes 46 through the corresponding bolt insertion holes 45.

The surface 14*a* of the plate 14 facing the supporting member 39 has three first recesses 51 (only one recess 51 is illustrated in FIG. 1). The three first recesses 51 are arranged in the circumferential direction of the high-speed shaft 31 at specified intervals (e.g., at 120-degree intervals). The arrangement of the three first recesses 51 corresponds to the arrangement of the three rollers 35. The three first recesses 51 each have therein an annular first roller bearing 52.

The surface 40*a* of the supporting base 40 facing the plate 14 has three second recesses 53 (only one recess 53 is illustrated in FIG. 1). The three second recesses 53 are arranged in the circumferential direction of the high-speed shaft 31 at specified intervals (e.g., at 120-degree intervals). The arrangement of the three second recesses 53 corresponds to the arrangement of the three rollers 35. The three second recesses 53 each have therein an annular second roller bearing 54.

The first protrusions 35*c* of the rollers 35 are inserted into the first roller bearings 52 in the first recesses 51, and rotatably supported by the plate 14 via the first roller bearings 52. The second protrusions 35*e* of the rollers 35 are inserted into the second roller bearings 54 in the second recesses 53, and rotatably supported by the supporting member 39 via the second roller bearings 54.

The high-speed shaft 31 has a pair of flange portions 31*f* that is opposed to and distanced from each other in the axial direction of the high-speed shaft 31. The roller portions 35*a* of the three rollers 35 are held between the pair of flange portions 31*f*. This restricts misalignment between the high-speed shaft 31 and the roller portions 35*a* of the three rollers 35 in the axial direction of the high-speed shaft 31.

Referring to FIG. 2, the three rollers 35, the ring member 32, and the high-speed shaft 31 are unitized in a state where the three rollers 35, the high-speed shaft 31, and the cylindrical portion 34 push against each other. The high-speed shaft 31 is rotatably supported by the three rollers 35.

Pushing loads are applied to ring-side contact areas Pa where the outer circumferential surfaces of the roller portions 35*a* of the three rollers 35 are in contact with the inner circumferential surface of the cylindrical portion 34. In addition, pushing loads are applied to shaft-side contact areas Pb where the outer circumferential surfaces of the roller portions 35*a* of the three rollers 35 are in contact with the outer circumferential surface of high-speed shaft 31. The ring-side contact areas Pa and the shaft-side contact areas Pb extend in the axial direction of the high-speed shaft 31.

When the electric motor 17 is driven and the low-speed shaft 16 and the ring member 32 are rotated, the torque of the ring member 32 is transmitted to the three rollers 35 through the ring-side contact areas Pa to rotate the three rollers 35. A sum of the torque of the three rollers 35 is transmitted to the high-speed shaft 31 through the shaft-side contact areas Pb. In consequence, the high-speed shaft 31 is rotated. At this time, the ring member 32 rotates at the same speed as that of the low-speed shaft 16, and the three rollers 35 rotate at a higher speed than the low-speed shaft 16 rotates. The high-speed shaft 31 rotates at a higher speed than the three rollers 35 rotate because the outer diameter of the high-speed shaft 31 is smaller than that of the three rollers 35. Accordingly, the speed increaser 30 causes the high-speed shaft 31 to rotate at a higher speed than the low-speed shaft 16 rotates.

Referring to FIG. 1, the centrifugal compressor 10 includes an oil pan 55 for storing therein oil supplied to the speed increaser 30. The oil pan 55 is formed in the bottom wall 12*a* of the motor housing 12. The oil pan 55 is located in a part of the bottom wall 12*a* beside outer circumferential surface of the bottom wall 12*a* of the motor housing 12.

The centrifugal compressor 10 includes an oil pump 57 and an oil supply passage 56 through which oil stored in the oil pan 55 is supplied to the speed increaser chamber 13*c*. The oil pump 57 that pumps up and discharges the oil stored in the oil pan 55 is disposed in the oil supply passage 56. The oil pump 57 is formed in the bottom wall 12*a* of the motor housing 12. The oil pump 57 is, for example, a trochoid pump. The oil pump 57 is connected to the first end portion of the low-speed shaft 16. The oil pump 57 is driven with rotation of the low-speed shaft 16.

The oil supply passage 56 has a first connecting passage 56*a* connecting the oil pan 55 to the oil pump 57, and a second connecting passage 56*b* connecting the oil pump 57 to the speed increaser chamber 13*c*. The first connecting passage 56*a* is formed in the motor housing 12. A first end of the first connecting passage 56*a* extends into the oil pan 55. A second end of the first connecting passage 56*a* is connected to an oil intake port 57*a* of the oil pump 57. The second connecting passage 56*b* passes through the motor housing 12 and the speed increaser housing 13. A first end of the second connecting passage 56*b* is connected to an oil discharge port 57*b* of the oil pump 57. A second end of the second connecting passage 56*b* opens at an upper portion of the speed increaser chamber 13*c* in the gravity direction.

The centrifugal compressor 10 includes an oil return passage 58 through which the oil in the speed increaser chamber 13*c* is returned to the oil pan 55, and an oil cooler 59 cooling the oil flowing through the oil return passage 58. The oil cooler 59 has a bottomed cylindrical cover member 59*a* attached to the outer circumferential surface of the circumferential wall 12*b* of the motor housing 12. The inner surface of the cover member 59*a* and the outer circumferential surface of the circumferential wall 12*b* of the motor housing 12 cooperate to define a space 59*b*. The oil cooler 59 also has a cooling pipe 59*c* disposed in the space 59*b*. The opposite end portions of the cooling pipe 59*c* are supported by the motor housing 12. The cooling pipe 59*c* forms a part of the oil return passage 58.

The cover member 59*a* has an introduction pipe 59*d* and a discharge pipe 59*e*. Low-temperature fluid is introduced into the space 59*b* from the introduction pipe 59*d*. The low-temperature fluid introduced into the space 59*b* is discharged through the discharge pipe 59*e*, and then cooled down by a cooling device (not shown). After that, the low-temperature fluid is introduced into the space 59*b* again through the introduction pipe 59*d*. In one example, the low-temperature fluid is water.

The oil return passage 58 has a third connecting passage 58*a* connecting the speed increaser chamber 13*c* to the oil cooler 59, and a fourth connecting passage 58*b* connecting the oil cooler 59 to the oil pan 55. The third connecting passage 58*a* passes through the speed increaser housing 13, and extends into the circumferential wall 12*b* of the motor housing 12. A first end of the third connecting passage 58*a* opens at a lower portion of the speed increaser chamber 13*c* in the gravity direction. A second end of the third connecting passage 58*a* is connected to a first end of the cooling pipe 59*c*. The fourth connecting passage 58*b* is formed in the motor housing 12. A first end of the fourth connecting passage 58*b* is connected to a second end of the cooling pipe 59*c*. A second end of the fourth connecting passage 58*b* opens at the oil pan 55.

When the electric motor 17 is driven, the low-speed shaft 16 is rotated to drive the oil pump 57. The oil stored in the oil pan 55 is pumped up into the oil pump 57 through the first connecting passage 56*a* and the oil intake port 57*a*, and then, discharged to the second connecting passage 56*b* from the oil discharge port 57*b*. The oil pump 57 is driven such that an amount of oil discharged from the oil discharge port 57*b* is linearly increased as the number of rotation of the low-speed shaft 16 increases. The oil discharged to the second connecting passage 56*b* flows therethrough into the speed increaser chamber 13*c*, and is supplied to the outer circumferential surfaces of the roller portions 35*a* and the like. The oil supplied to the outer circumferential surfaces of the roller portions 35*a* improves lubrication of sliding areas between the roller portions 35*a* and the high-speed shaft 31.

The oil having contributed to the lubrication of the sliding areas between the roller portions 35*a* and the high-speed shaft 31 is stored in the speed increaser chamber 13*c*. The oil stored in the speed increaser chamber 13*c* flows into the third connecting passage 58*a*, and then, passes through the third connecting passage 58*a*, the cooling pipe 59*c*, and the fourth connecting passage 58*b*. While passing through the cooling pipe 59*c*, the oil is cooled by heat exchange with the low-temperature fluid introduced to the space 59*b* of the oil cooler 59. Then, the oil cooled by the oil cooler 59 is stored in the oil pan 55.

The centrifugal compressor 10 includes a pressure reduction passage 60 communicating with the oil pan 55 and the outside. The pressure reduction passage 60 has a connecting passage 60*a*, a buffer chamber 60*b*, and a discharge hole 60*c*. The buffer chamber 60*b* is formed in the bottom wall 12*a* of the motor housing 12. The connecting passage 60*a* is formed in the bottom wall 12*a* of the motor housing 12. The connecting passage 60*a* is in communication with the oil pan 55 and the buffer chamber 60*b*. A first end of the connecting passage 60*a* opens at an upper portion of the oil pan 55 in the gravity direction. A second end of the connecting passage 60*a* opens at a lower portion of the buffer chamber 60*b* in the gravity direction. The discharge hole 60*c* is formed in the bottom wall 12*a* of the motor housing 12. A first end of the discharge hole 60*c* opens at an upper portion of the buffer chamber 60*b* in the gravity direction. A second end of the discharge hole 60*c* opens at the outer surface of the bottom wall 12*a* of the motor housing 12 and is in communication with the outside.

The centrifugal compressor 10 includes a bypass passage 61. The bypass passage 61 passes through the speed increaser housing 13 and the motor housing 12. A first end of the bypass passage 61 opens at an upper portion of the speed increaser chamber 13*c* in the gravity direction. A second end of the bypass passage 61 opens at an upper portion of the oil pan 55 in the gravity direction. Thus, the speed increaser chamber 13*c* and the oil pan 55 are in communication with each other via the bypass passage 61. Specifically, the bypass passage 61 has the first end communicating with the speed increaser chamber 13*c* and the second end communicating with the oil pan 55.

The following will describe functions according to the present embodiment.

While the centrifugal compressor 10 is operated, even when air leaks from the impeller chamber 15*b* into the speed increaser chamber 13*c* through the gap between the outer circumferential surface of the high-speed shaft 31 and the inner circumferential surface of the shaft insertion hole 14*h*, air in the speed increaser chamber 13*c* is discharged to the outside through the oil return passage 58, the oil pan 55, and the pressure reduction passage 60. This restricts an increase of pressure in the speed increaser chamber 13*c*. Thus, even under the circumstances where pressure of the impeller chamber 15*b* is lower than that of the speed increaser chamber 13*c*, for example, the impeller 24 rotates at a low speed or the operation of the centrifugal compressor 10 stops, the difference between the pressure of the speed increaser chamber 13*c* and the pressure of the impeller chamber 15*b* becomes smaller. This means that the oil in the speed increaser chamber 13*c* is restricted from leaking into the impeller chamber 15*b* through the gap between the outer circumferential surface of the high-speed shaft 31 and the inner circumferential surface of the shaft insertion hole 14*h*.

The speed increaser chamber 13*c* is in communication with the oil pan 55 via the bypass passage 61. With this configuration, the speed increaser chamber 13*c* does not become a closed space even when the oil supply passage 56 and the oil return passage 58 are filled with oil, for example, during stoppage of operation of the centrifugal compressor 10. As a result, air in the speed increaser chamber 13*c* is discharged to the outside through the bypass passage 61, the oil pan 55, and the pressure reduction passage 60, even when the air in the speed increaser chamber 13*c* is expanded with an increase of the temperature in the speed increaser chamber 13*c*. In addition, the oil which is stirred by the speed increaser 30 in the speed increaser chamber 13*c* during the operation of the centrifugal compressor 10 may flow into the bypass passage 61. Even in this case, the oil becomes confluent with the oil stored in the oil pan 55 through the bypass passage 61, with the result that the oil hardly leaks out to the outside through the pressure reduction passage 60.

The above embodiment offers the following effects.

(1) The centrifugal compressor 10 includes the bypass passage 61 having the first end communicating with the speed increaser chamber 13*c* and the second end communicating with the oil pan 55. With this configuration, even when air in the speed increaser chamber 13*c* is expanded with an increase in the temperature in the speed increaser chamber 13*c*, the air in the speed increaser chamber 13*c* is discharged to the outside through the bypass passage 61, the oil pan 55, and the pressure reduction passage 60. The bypass passage 61 restricts the oil pushed out by the expanded air in the speed increaser chamber 13*c* from flowing into the oil pan 55 through the oil return passage 58. This restricts increasing a level of oil in the oil pan 55, so that leakage of the oil to the outside through the pressure reduction passage 60 is restricted. Therefore, the reduction of an amount of oil supplied to the speed increaser 30 is restricted.

While the centrifugal compressor 10 is operated, even when air leaks from the impeller chamber 15*b* into the speed increaser chamber 13*c* through the gap between the outer circumferential surface of the high-speed shaft 31 and the inner circumferential surface of the shaft insertion hole 14*h*, air in the speed increaser chamber 13*c* is discharged to the outside through the oil return passage 58, the oil pan 55 and the pressure reduction passage 60. This restricts an increase of the pressure in the speed increaser chamber 13*c*. In addition, the oil which is stirred by the speed increaser 30 in the speed increaser chamber 13*c* during the operation of the centrifugal compressor 10 may flow into the bypass passage 61. Even in this case, the oil becomes confluent with the oil stored in the oil pan 55 through the bypass passage 61. For this reason, the oil hardly leaks out to the outside through the pressure reduction passage 60. Thus, providing the bypass passage 61 in the centrifugal compressor 10 also restricts the reduction of an amount of oil supplied to the speed increaser 30. Therefore, the present disclosure restricts the reduction of the amount of oil supplied to the speed increaser 30 in addition to restricting an increase of pressure in the speed increaser chamber 13*c*.

(2) In the present embodiment, leakage of oil from the speed increaser chamber 13*c* to the impeller chamber 15*b* is restricted. This restricts the oil from being supplied to a fuel cell together with air compressed by the centrifugal compressor 10, avoiding a reduction of the power generation efficiency of the fuel cell.

The above embodiment may be modified as described below. The above embodiment and the following modifications may be combined each other appropriately, as long as there is no technical contradictions.

In the embodiment, the buffer chamber 60*b* which forms part of pressure reduction passage 60 may not be formed in the motor housing 12.

In the embodiment, for example, the pressure reduction valve which opens when pressure in the speed increaser chamber 13*c* reaches a predetermined pressure may be formed in the discharge hole 60*c* of the pressure reduction passage 60. The pressure reduction valve may be a solenoid valve configured to open and close by electrical signals only while the centrifugal compressor 10 is operated.

In the embodiment, the centrifugal compressor 10 may be applied to any unit and compress any gas. For example, the centrifugal compressor 10 may be applied to an air conditioning unit and compress refrigerant gas. In addition, the centrifugal compressor 10 may be mounted to any unit other than a vehicle.

What is claimed is:

1. A centrifugal compressor comprising:

a low-speed shaft;

an impeller integrally rotated with a high-speed shaft to compress gas;

a speed increaser transmitting power of the low-speed shaft to the high-speed shaft;

a housing having therein an impeller chamber accommodating the impeller and a speed increaser chamber accommodating the speed increaser;

a separation wall separating the impeller chamber from the speed increaser chamber;

a shaft insertion hole through which the high-speed shaft is inserted, the shaft insertion hole being formed in the separation wall;

a seal member disposed between an outer circumferential surface of the high-speed shaft and an inner circumferential surface of the shaft insertion hole;

an oil pan for storing therein oil supplied to the speed increaser;

an oil supply passage having an end near the oil pan, the end of the oil supply passage being connected to oil stored in the oil pan, wherein the oil stored in the oil pan is supplied to the speed increaser chamber through the oil supply passage;

an oil return passage having an end near the speed increaser, the end of the oil return passage being connected to oil in the speed increaser chamber, wherein the oil in the speed increaser chamber is returned to the oil pan through the oil return passage; and a pressure reduction passage communicating with the oil pan and an outside, the pressure reduction passage having an end connected to a first opening at an upper portion of the oil pan to open to an air layer in the oil pan, wherein the centrifugal compressor includes a bypass passage having a first end and a second end, the first end being connected to an upper portion of the speed increaser chamber to open to an air layer in the speed increaser chamber, and the second end being connected to a second opening in the upper portion of the oil pan to open to the air layer in the oil pan, whereby air in the speed increaser chamber discharged to the bypass passage flows into the upper portion of the oil pan via the second opening and then into the pressure reduction passage via the first opening to flow to the outside.

* * * * *